US010891914B2

(12) United States Patent
Seong et al.

(10) Patent No.: US 10,891,914 B2
(45) Date of Patent: Jan. 12, 2021

(54) CONTROL BUFFER FOR REDUCING EMI AND SOURCE DRIVER INCLUDING THE SAME

(71) Applicant: Magnachip Semiconductor, Ltd., Cheongju-si (KR)

(72) Inventors: Eun Kyu Seong, Cheongju-si (KR); Hyoung Kyu Kim, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 16/429,697

(22) Filed: Jun. 3, 2019

(65) Prior Publication Data

US 2020/0035193 A1 Jan. 30, 2020

(30) Foreign Application Priority Data

Jul. 27, 2018 (KR) ..... 10-2018-0088027

(51) Int. Cl.
*G09G 5/00* (2006.01)

(52) U.S. Cl.
CPC ..... *G09G 5/003* (2013.01); *G09G 2310/0291* (2013.01)

(58) Field of Classification Search
CPC .. G09G 3/20; G09G 5/003; G09G 2310/0291; G09G 2310/06; G09G 2310/08; G09G 2310/027; G09G 2330/06; G09G 3/3688; G09G 3/3275; G09G 3/3677; G09G 2310/0286; G09G 3/3685
See application file for complete search history.

(56) References Cited

U.S. PATENT DOCUMENTS

| | | | | |
|---|---|---|---|---|
| 5,760,620 | A * | 6/1998 | Doluca | H03F 3/3001 326/83 |
| 5,926,156 | A * | 7/1999 | Katoh | G09G 3/3677 345/55 |
| 6,335,638 | B1 | 1/2002 | Kwong et al. | |
| 2003/0001616 | A1* | 1/2003 | Fujikawa | H03K 19/01707 326/80 |
| 2007/0040562 | A1* | 2/2007 | La Placa | H03K 17/167 324/678 |
| 2009/0168549 | A1* | 7/2009 | Jeon | G11C 29/02 365/189.05 |
| 2010/0103315 | A1* | 4/2010 | Li | G09G 3/3688 348/500 |
| 2013/0162304 | A1* | 6/2013 | Kim | G09G 3/3677 327/109 |
| 2017/0111047 | A1* | 4/2017 | Mai | H03K 19/01707 |
| 2018/0012540 | A1* | 1/2018 | Hosoyachi | G09G 5/10 |

* cited by examiner

*Primary Examiner* — Koosha Sharifi-Tafreshi
(74) *Attorney, Agent, or Firm* — NSIP Law

(57) ABSTRACT

A control buffer in a source driver includes a first CMOS inverter configured to output a switch signal to control turning on and off of a switch, and a first tri-state inverter that is connected to the first CMOS inverter and configured to selectively adjust a size of the control buffer, wherein a slew rate of the switch signal is adjusted depending on the size of the control buffer.

21 Claims, 9 Drawing Sheets

FIG. 9

| SIZE_OP _1 | SIZE_OP _2 | SIZE_OP _3 | SW_ON | Note. |
|---|---|---|---|---|
| L | L | L | 1/4 SIZE | EMI peak decreased |
| H | L | L | 2/4 SIZE | |
| L | H | L | 3/4 SIZE | |
| L | L | H | 4/4 SIZE | |
| H | H | L | 4/4 SIZE | |
| H | L | H | 5/4 SIZE | |
| L | H | H | 6/4 SIZE | |
| H | H | H | 7/4 SIZE | Slew rate increased |

CONTROL BUFFER FOR REDUCING EMI AND SOURCE DRIVER INCLUDING THE SAME

CROSS-REFERENCE TO RELATED APPLICATIONS

This application claims the benefit under 35 USC 119(a) of Korean Patent Application No. 10-2018-0088027 filed on Jul. 27, 2018 in the Korean Intellectual Property Office, the entire disclosure of which is incorporated herein by reference for all purposes.

BACKGROUND

1. Field

The following description relates to a control buffer included in a source driver. The following description also relates to a control buffer that is capable of reducing electromagnetic interference (EMI). Furthermore, the following description relates to a source driver including such a control buffer.

2. Description of Related Art

Integrated Circuits (ICs) in which large numbers of transistors are included on one semiconductor chip are referred to as Large Scale Integration (LSI), very LSI, or ultra LSI ICs depending on the density of integration of transistors on such ICs.

As semiconductors become more integrated, electromagnetic interference (EMI) phenomena increase. Thus, reducing EMI is an important issue in semiconductor and IC design.

Alternative technologies disclose a clock driver that is able to reduce EMI by adjusting a slew rate at each driving time. In further detail, at a driving start time and a driving end time, driving is conducted using a small-size driver. During the transitional period, driving is conducted using a large-size driver to reduce an average slew rate and EMI accordingly.

Meanwhile, in a display device, in order to supply driving voltages to source lines of a display panel, each of the output switches of a source driver is turned on simultaneously. When each output switch is turned on simultaneously, high peak current occurs at a switch signal that controls each output switch. Also, peak current of the switch signal increases as resolution of the display increases.

Such an approach may induce the occurrence of a high level of electromagnetic interference (EMI), which may affect display image quality. A high level of EMI may also affect receiver sensitivity for mobile phones adversely.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a control buffer in a source driver includes a first CMOS inverter configured to output a switch signal to control turning on and off of a switch, and a first tri-state inverter that is connected to the first CMOS inverter and configured to selectively adjust a size of the control buffer, wherein a slew rate of the switch signal is adjusted depending on the size of the control buffer.

The first CMOS inverter may include an input line configured to receive a first control signal, an output line configured to output the switch signal, and each of a first PMOS transistor and a first NMOS transistor including a gate commonly connected to the input line and a drain commonly connected to the output line, wherein the first CMOS inverter may be configured to invert the first control signal received from the input line and may be configured to output the inverted first control signal to the output line as the switch signal.

The first PMOS transistor and the first NMOS transistor may each be a ¼ size transistor.

The first tri-state inverter, depending on a state of a second control signal, may be configured to operate as an inverter that inverts the first control signal received from the input line and outputs the inverted first control signal to the output line of the first CMOS inverter, or may be placed in a high impedance state and may be configured not to output a signal to the output line, regardless of the first control signal.

The size of the control buffer may increase in response to the first tri-state inverter operating as the inverter.

The first tri-state inverter may include a second NMOS transistor that includes a gate configured to receive the second control signal, a second PMOS transistor that includes a gate configured to receive a complementary signal of the second control signal, and each of a third PMOS transistor and a third NMOS transistor including a gate commonly connected to the input line and a drain commonly connected to the output line, wherein a drain of the second PMOS transistor may be connected to a source of the third PMOS transistor, and a drain of the second NMOS transistor may be connected to a source of the third NMOS transistor.

The third PMOS transistor and the third NMOS transistor may each be a ¾ size transistor.

The control buffer may further include a second CMOS inverter configured to invert the switch signal to output a complementary signal of the switch signal, and a second tri-state inverter that is connected to the second CMOS inverter and configured to selectively adjust the size of the control buffer, wherein a slew rate of the complementary signal of the switch signal may be adjusted depending on the size of the control buffer.

The switch may include a PMOS transistor and an NMOS transistor connected in parallel, a gate of the PMOS transistor may be configured to receive the complementary signal of the switch signal, and a gate of the NMOS transistor may be configured to receive the switch signal.

In another general aspect, a control buffer in a source driver includes a CMOS inverter configured to output a switch signal to control turning on and off of a switch controlled by the control buffer, and tri-state inverters that are each connected to the CMOS inverter, and depending on a state of each of which a size of the control buffer is selectively adjusted, wherein a slew rate of the switch signal is adjusted depending on the size of the control buffer.

As the size of the control buffer decreases, electromagnetic interference (EMI) of the switch signal may be reduced.

The CMOS inverter may include an input line configured to receive a switch control signal, and an output line configured to output the switch signal, wherein the CMOS inverter may be configured to invert the switch control signal received from the input line and may be configured to output the inverted switch control signal into the output line as the switch signal.

Each tri-state inverter, depending on a state of a size control signal inputted therein, may be configured to operate as an inverter that inverts the switch control signal received from the input line and may be configured to output the inverted switch control signal into the output line of the CMOS inverter, or may be placed in a high impedance state and may be configured not to output a signal into the output line, regardless of the size control signal.

The size control signal may include a first size control signal, a second size control signal, and a third size control signal, the tri-state inverters may include a first tri-state inverter configured to operate based on the first size control signal, a second tri-state inverter configured to operate based on the second size control signal, and a third tri-state inverter configured to operate based on the third size control signal, and each of the tri-state inverters may include a corresponding second NMOS transistor including a gate configured to receive a corresponding size control signal, a corresponding second PMOS transistor including a gate configured to receive a corresponding complementary signal of the corresponding size control signal, and a corresponding third PMOS transistor and a corresponding third NMOS transistor including a gate commonly connected to the input line and a drain commonly connected to the output line, wherein a drain of each corresponding second PMOS transistor may be connected to a source of each corresponding third PMOS transistor, and a drain of each corresponding second NMOS transistor may be connected to a source of each corresponding third NMOS transistor.

Each of the tri-state inverters may be characterized such that, depending on a state of each of the size control signals, the corresponding third PMOS transistor or the corresponding third NMOS transistor may be configured to operate as an inverter, or the corresponding third PMOS transistor and the corresponding third NMOS transistor may be turned off, and as a size of the corresponding third PMOS transistor or the corresponding third NMOS transistor increases, a size of a control buffer may increase.

In response to the switch control signal being in a high state, the size of the control buffer may be adjusted by a combination of the third NMOS transistor of the first tri-state inverter, the third NMOS transistor of the second tri-state inverter, and the third NMOS transistor of the third tri-state inverter, depending on a state of each of the size control signals.

In response to the switch control signal being in a low state, the size of the control buffer may be adjusted by a combination of the third PMOS transistor of the first tri-state inverter, the third PMOS transistor of the second tri-state inverter, and the third PMOS transistor of the third tri-state inverter, depending on a state of each of the size control signals.

In response to the first size control signal, the second size control signal, and the third size control signal all being in a low state, the control buffer may have a smallest size, and in response to the first size control signal, the second size control signal, and the third size control signal all being in a high state, the control buffer may have a largest size.

In another general aspect, a source driver of a display panel includes a channel amplifier configured to receive a driving voltage to be output into a source line of the display panel for amplification, a switch that connects an output terminal of the channel amplifier to the source line, and a control buffer configured to supply a switch signal to the switch to control of turning on and off of the switch, wherein a size of the control buffer is selectively adjusted depending on a load of the display panel.

As the load of the display panel increases, the size of the control buffer may increase, and as the load of the display panel decreases, the size of the control buffer may decrease.

The control buffer may include a CMOS inverter configured to output the switch signal based on a switch control signal, and a tri-state inverter, connected to the CMOS inverter, configured to selectively adjust the size of the control buffer based on a size control signal, wherein operation of the tri-state inverter may be controlled depending on the load of the display panel.

The tri-state inverter, depending on a state of the size control signal, may be configured to operate as an inverter that inverts the switch control signal and may be configured to output the inverted switch control signal as the switch signal, or may be placed in a high impedance state and may be configured not to output a signal, regardless of the size control signal.

Other features and aspects will be apparent from the following detailed description, the drawings, and the claims.

BRIEF DESCRIPTION OF THE DRAWINGS

FIG. 9 illustrates an operating principle of the control buffer of the example of FIG. 8.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
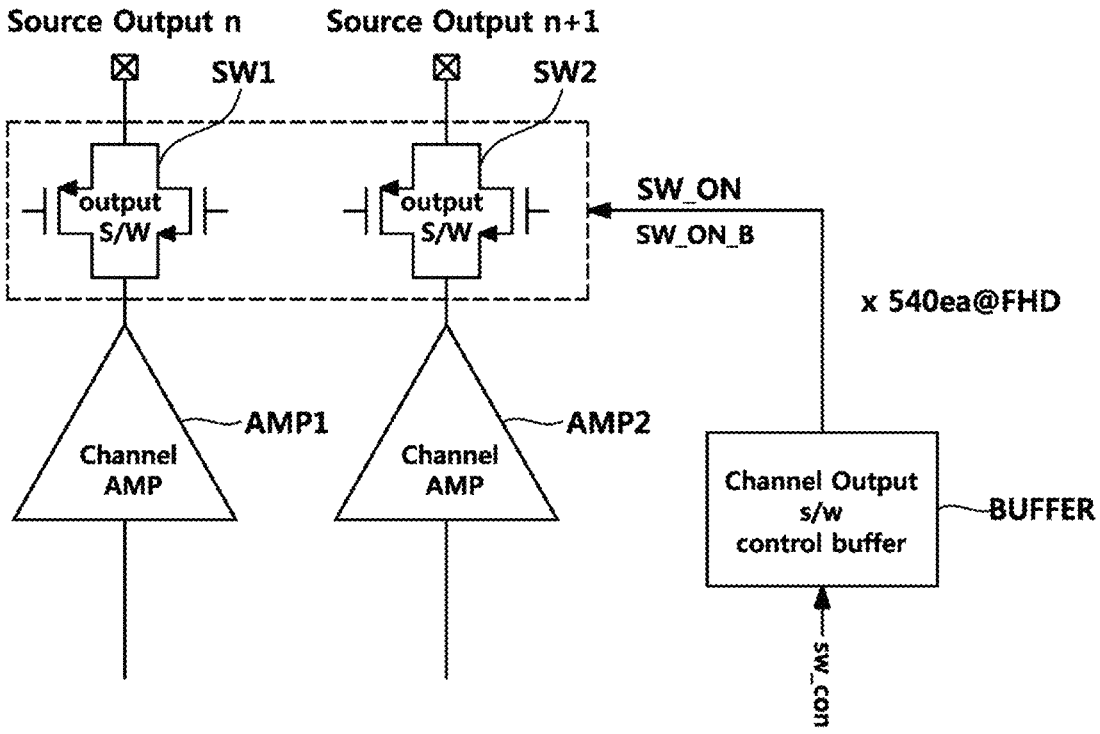
FIG. 1 is a circuit diagram for explaining a source driver in alternative technologies.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

The present examples provided to solve the above-described problems, and a control buffer according to the present examples aims to adjust a slew rate of a switch signal that controls respective output switches of a source driver, depending on a size of the control buffer.

The second purpose of the present examples is to selectively adjust a size of the control buffer depending on load of a display panel, thereby providing a source driver that reduces electromagnetic interference (EMI) of the switch signal.

FIG. 1 is a circuit diagram for explaining a source driver in alternative technologies. Referring to the example of FIG. 1, each of channel amplifiers AMP1 and AMP2 amplifies drive voltage, and each of output switches SW1 and SW2, corresponding to each channel amplifier of AMP1 and AMP2, respectively, supplies an amplified drive voltage to each source line of a display panel. When a source driver supplies drive voltage to each source line, switch-on signals SW_ON and SW_ON_B, outputted from a control buffer BUFFER, are simultaneously inputted into each output switch SW1 and SW2. Therefore, while each of output switches SW1 and SW2 is simultaneously turned on, drive voltages of each of channel amplifiers AMP1 and AMP2 are supplied to each source line. Throughout the present disclosure, the term "control buffer" refers to a control buffer circuit.

As display resolution increases, a number of source lines of a display panel increases proportionally. Therefore, a source driver that matches the number of source lines of the display panel is potentially required. For example, at least 1080 channel amplifiers are required in a source driver that implements FHD or higher resolution, given that FHD corresponds to a resolution of 1920 by 1080 pixels.

In alternative technologies, all the source lines are driven by a single, large control buffer. That is, as a number of source lines increases, a number of channel amplifiers increases, and a number of output switches connected to the channel amplifiers also increases. Therefore, the size of the control buffer needs to be large, and becomes larger as the number of source lines increases.

However, as the size of the control buffer increases, a propagation delay occurs between a channel amplifier located in the center and a channel amplifier located at the edge. Also, in such an example, when an output switch is turned on at the same time as another output switch, a large electromagnetic interference (EMI) phenomenon is caused during a time when a high peak current is generated.

Figure 2:
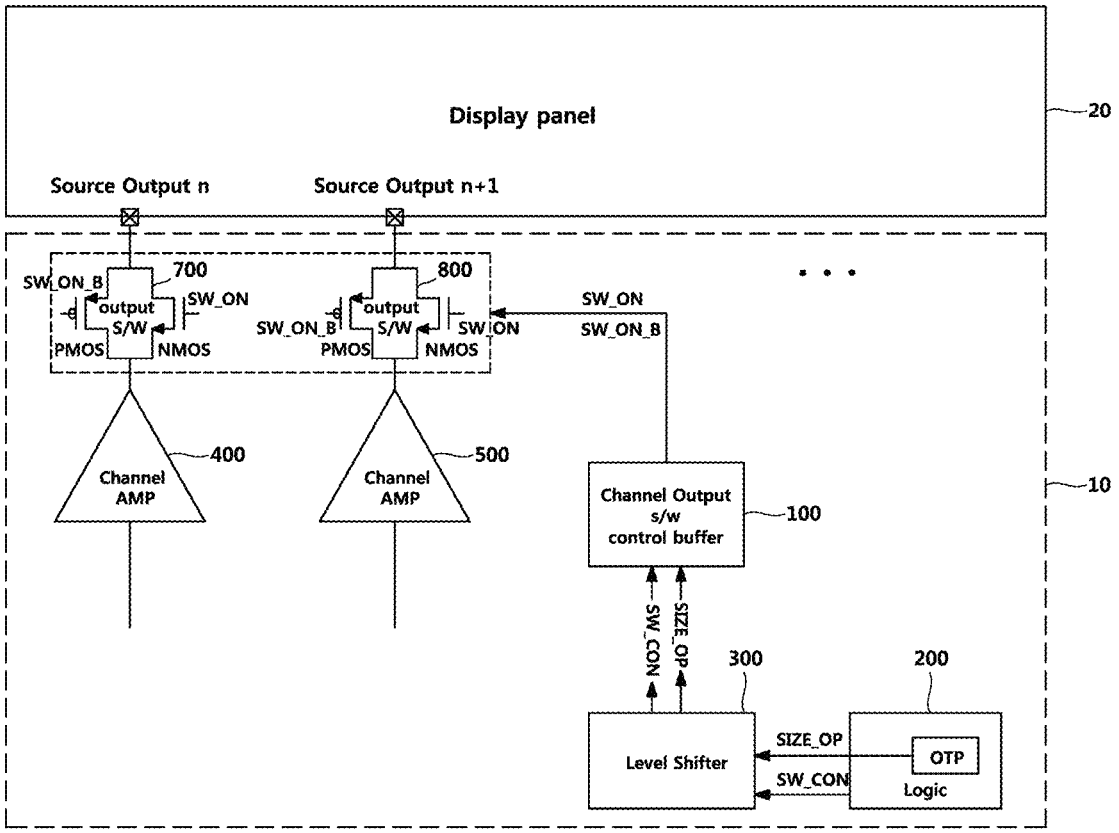
FIG. 2 is a view of a display device including a source driver according to one or more examples.

FIG. 2 illustrates a display device including a source driver according to one or more examples. A source driver according to one embodiment selectively adjust the size of a control buffer in accordance with the load of a display panel, it is possible to reduce EMI of a switch signal that controls, although a display resolution may be increased.

Referring to the example of FIG. 2, a display device includes a display panel 20 and a source driver 10. The source driver 10 supplies a drive voltage to each source line of the display panel 20. The source driver 10 includes a control buffer 100, a logic 200, a level shifter 300, a first channel amplifier 400, a second channel amplifier 500, a first switch 700, and a second switch 800. However, the source driver 10 is not limited to these elements, and may include other elements, as appropriate.

With respect to the first channel amplifier 400, second channel amplifier 500, first switch 700, and second switch 800, only two channels are illustrated for convenience of explanation, from among source driver channels that process n-bit digital data. Also, in the present examples, one control channel is used for 2 channels, but the present examples are not limited to this example, and one control buffer may possibly be used for 4 channels or 8 channels, as non-limiting examples.

The first channel amplifier 400 receives and amplifies a first drive voltage that is to be output to a first source line of a display panel 20. A second channel amplifier 500 receives and amplifies a second drive voltage that is to be output to a second source line of the second display panel 20.

The first switch 700 connects an output terminal of the first channel amplifier 400 to the first source line, and the second switch 800 connects an output terminal of the second channel amplifier 500 to the second source line.

The control buffer 100 supplies a switch signal SW_ON and a complementary signal SW_ON_B of the switch signal, to the first switch 700 and the second switch 800 respectively, based on the first control signal SW_CON.

Each of the first switch 700 and the second switch 800 includes a PMOS transistor and an NMOS transistor connected in parallel. For each of the first switch 700 and the second switch 800 a gate of the PMOS transistor receives the complementary signal SW_ON_B and a gate of the NMOS transistor receives the switch signal SW_ON.

In particular, the present examples allow for selectively controlling the size of the control buffer 100 based on the load of the display panel 20, by adding a second control signal SIZE_OP input to the control buffer 100.

The logic 200 generates a first control signal SW_CON and a second control signal SIZE_OP. The first control signal SW_CON is a signal for controlling the states of the switch signal SW_ON and the complementary signal SW_ON_B of the switch signal. The second control signal SIZE_OP is a signal for controlling the size of the control buffer 100. According to examples, the second control signal SIZE_OP may be determined according to the load of the display panel 20 and is stored in advance in a One-Time Programmable (OTP) memory.

Accordingly, the level shifter 300 receives the first control signal SW_CON and the second control signal SIZE_OP from the logic 200 and shifts the level of each of the first control signal SW_CON and the second control signal SIZE_OP in order to output it to the control buffer 100.

As the load of the display panel 20 increases, the source driver 10 increases the size of the control buffer 100 appropriately and increases the driving capability of each of the switch signal SW_ON and the complementary signal SW_ON_B of the switch signal, as well.

However, when the load of the display panel 20 decreases, the source driver 10 reduces the size of the control buffer 100 accordingly, thereby reducing the slew rate of the first switch signal SW_ON and the second switch signal SW_ON_B. Therefore, the peak current of each of the switch signal SW_ON and the complementary signal SW_ON_B of the switch signal is reduced. As a result, the resultant EMI phenomenon is reduced.

Figure 3:
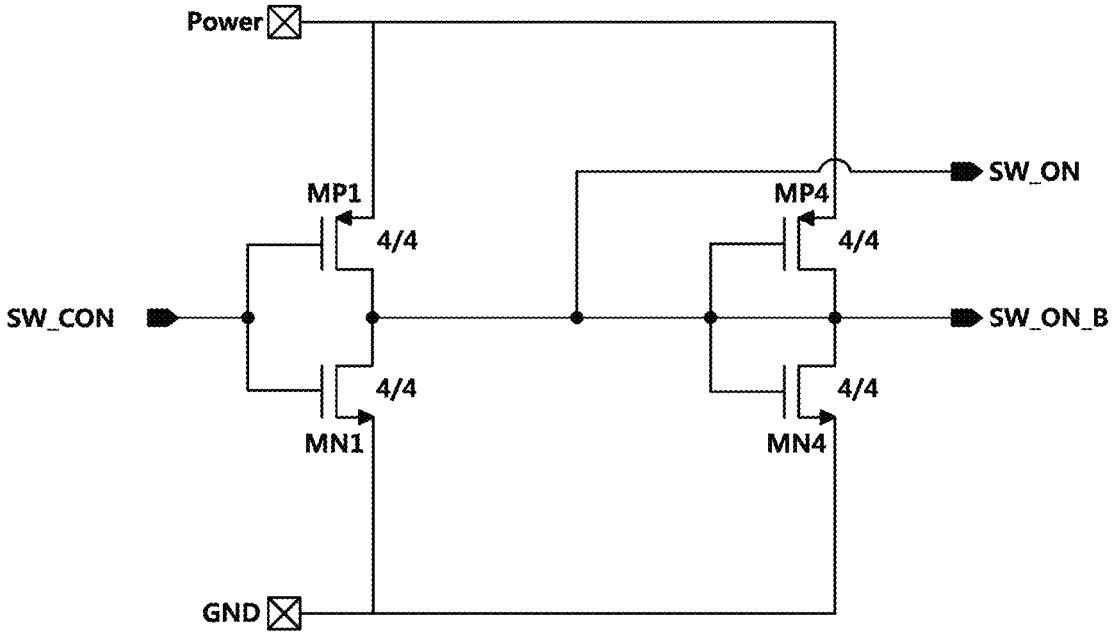
FIG. 3 is a control buffer in alternative technologies.
Figure 4:
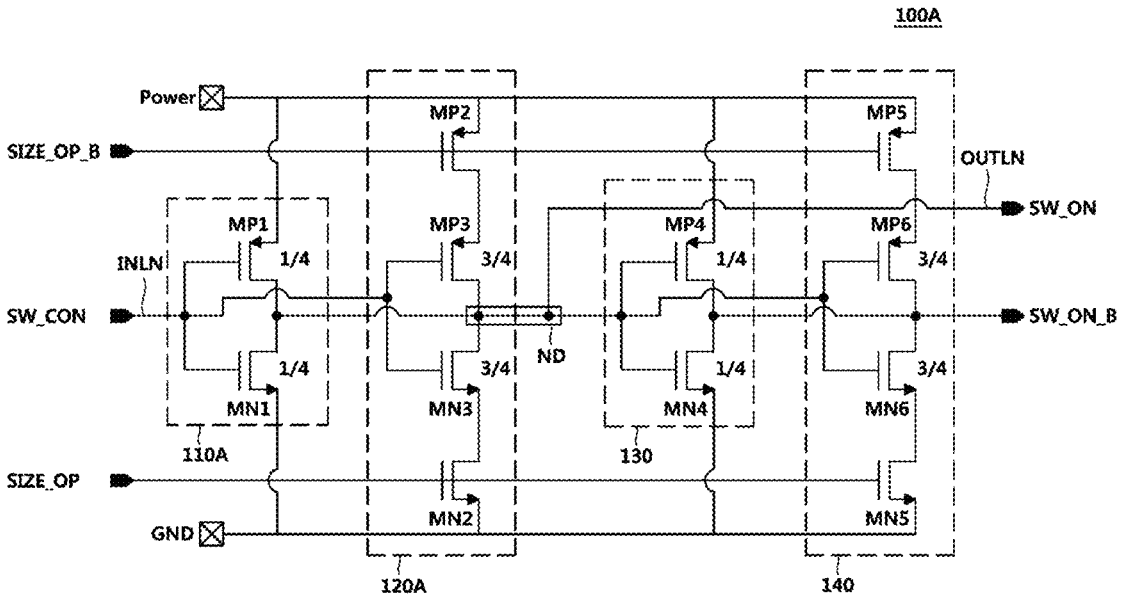
FIG. 4 is a control buffer according to an example.

FIG. 3 shows a control buffer in alternative technologies, and FIG. 4 shows a control buffer according to an example. Referring to the example of FIG. 3, the control buffer is implemented with two inverters. In such an example, each inverter is implemented as a series connection of a PMOS transistor and an NMOS transistor. That is, one inverter is implemented by a serial connection of a first PMOS transistor MP1 and a first NMOS transistor MN1, and the other inverter is implemented by a serial connection of a fourth PMOS transistor MP4 and a fourth NMOS transistor MN4.

When the control buffer is implemented with two inverters, as illustrated in the example of FIG. 3, the control buffer 100 according to one or more examples is potentially implemented as illustrated in the example of FIG. 4. Referring to the example of FIG. 4, a control buffer 100A includes a first CMOS inverter 110A, a first tri-state inverter 120A, a second CMOS inverter 130, and a second tri-state inverter 140. However, this is a non-limiting example, and other elements may also be present. The control buffer 100 according to the present examples may also be implemented by reducing the size of the transistors of the first CMOS inverter 110A by connecting the first tri-state inverter 120A to an output terminal of the first CMOS inverter 110A. Additionally, the control buffer 100 may be implemented by reducing the size of the transistors of the second CMOS inverter 130 and by connecting the second tri-state inverter 140 to an output terminal of the second CMOS inverter 130.

For example, the first CMOS inverter 110A outputs the switch signal SW_ON in response to the first control signal SW_CON. Accordingly, in such an example, the switch signal SW_ON controls on/off operation of each of the first switch 700 and the second switch 800.

For example, the first CMOS inverter 110A includes an input line INLN, an output line OUTLN, a first PMOS transistor MP1, and a first NMOS transistor MN1. The input line INLN receives the first control signal SW_CON, and the output line OUTLN outputs the switch signal SW_ON.

Additionally, the first PMOS transistor MP1 includes a gate connected to an input line INLN. The first PMOS transistor MP1 outputs a high signal to the output line OUTLN when the first control signal SW_CON is a low signal. The first NMOS transistor MN1 includes a gate connected to the input line INLN. The first NMOS transistor MN1 outputs a low signal to the output line OUTLN when the first control signal SW_CON is a high signal. Also, the drains of the first PMOS transistor MP1 and the first NMOS transistor MN1 are commonly connected to an output node ND.

In such an example, the first tri-state inverter 120A selectively adjusts the size of the control buffer 100A in response to the second control signal SIZE_OP and the complementary signal SIZE_OP_B of the second control signal. Thus, the slew rate of each of the switch signal SW_ON and the complementary signal SW_ON_B of the switch signal is adjusted based on the size of the control buffer 100A.

Additionally, in such an example, the first tri-state inverter 120A includes a second PMOS transistor MP2, a third PMOS transistor MP3, a second NMOS transistor MN2, and a third NMOS transistor MN3.

The third PMOS transistor MP3 includes a gate connected to the input line INLN. The third PMOS transistor MP3 outputs a high signal into the output line OUTLN when the first control signal SW_CON is a low signal. The third NMOS transistor MN3 includes a gate connected to the input line INLN. The third NMOS transistor MN3 outputs a low signal into the output line OUTLN when the first control signal SW_CON is a high signal. The drains of the third PMOS transistor MP3 and the third NMOS transistor MN3 are commonly connected to the output node ND.

A source of the second PMOS transistor MP2 is connected to a power source Power, a drain of the second PMOS transistor MP2 is connected to a source of the third PMOS transistor MP3, and a gate of the second PMOS transistor MP2 receives the complementary signal SIZE_OP_B of the second control signal. Additionally, a source of the second NMOS transistor MN2 is connected to the ground GND, a drain of the second NMOS transistor MN2 is connected to a source of the third NMOS transistor MN3, and a gate of the second NMOS transistor MN2 receives the second control signal SIZE_OP.

Depending on the states of the second control signal SIZE_OP and the complementary signal SIZE_OP_B of the second control signal, as a first scenario, the first tri-state inverter 120A inverts the first control signal SW_CON to output the first control signal SW_CON to the output line OUTLN, or as a second scenario, the first tri-state inverter 120A is placed in a high impedance, that is, floating, state and does not output a signal to the output line OUTLN regardless of the first control signal SW_CON. In the second scenario, the first tri-state inverter 120A is placed in a turned-off state. Thus, the size of the control buffer 100A increases accordingly when the first tri-state inverter 120A operates as an inverter.

For example, the first tri-state inverter 120A selectively adjusts the size of the control buffer 100A in response to the second control signal SIZE_OP and the complementary signal SIZE_OP_B of the second control signal. Thus, the slew rate of the switch signal SW_ON may be adjusted according to the size of the control buffer 100A.

A specific operation method of the first tri-state inverter 120A is described in greater detail, below, with reference to the examples of FIGS. 5 and 6.

For example, the second CMOS inverter 130 outputs the complementary signal SW_ON_B of the switch signal by inverting the switch signal SW_ON of the first CMOS inverter 110A. The complementary signal SW_ON_B of the switch signal may control the turning on/off of each of the first switch 700 and the second switch 800.

The second tri-state inverter 140 may selectively adjust the size of the control buffer 100A in response to the second control signal SIZE_OP and the complementary signal SIZE_OP_B of the second control signal. The slew rate of the complementary signal SIZE_OP_B of the switch signal may be adjusted according to the size of the control buffer 100A.

The structure and operation of each of the second CMOS inverter 130 and the second tri-state inverter 140 are substantially the same as or similar to the structure and operation of each of the first CMOS inverter 110A and the first tri-state inverter 120A, respectively. Thus, a discussion of the structure and operation of the second CMOS inverter 130 and the second tri-state inverter 140 is omitted, for brevity.

If the size of transistors MP1, MP4, MN1, and MN4 of each of the inverters 110A and 130 is reduced from 1 to ¼, the peak currents of the switch signals SW_ON and SW_ON_B are accordingly reduced and therefore EMI is reduced as well.

As the load of the display panel increases, tri-state inverters 120A and 140 that are respectively connected to output terminals of inverters 110A and 130 increase the size of the control buffer 100A to increase the slew rate of the switch signals SW_ON and SW_ON_B and also increase the driving capability of the switch signals SW_ON and SW_ON_B.

Figure 5:
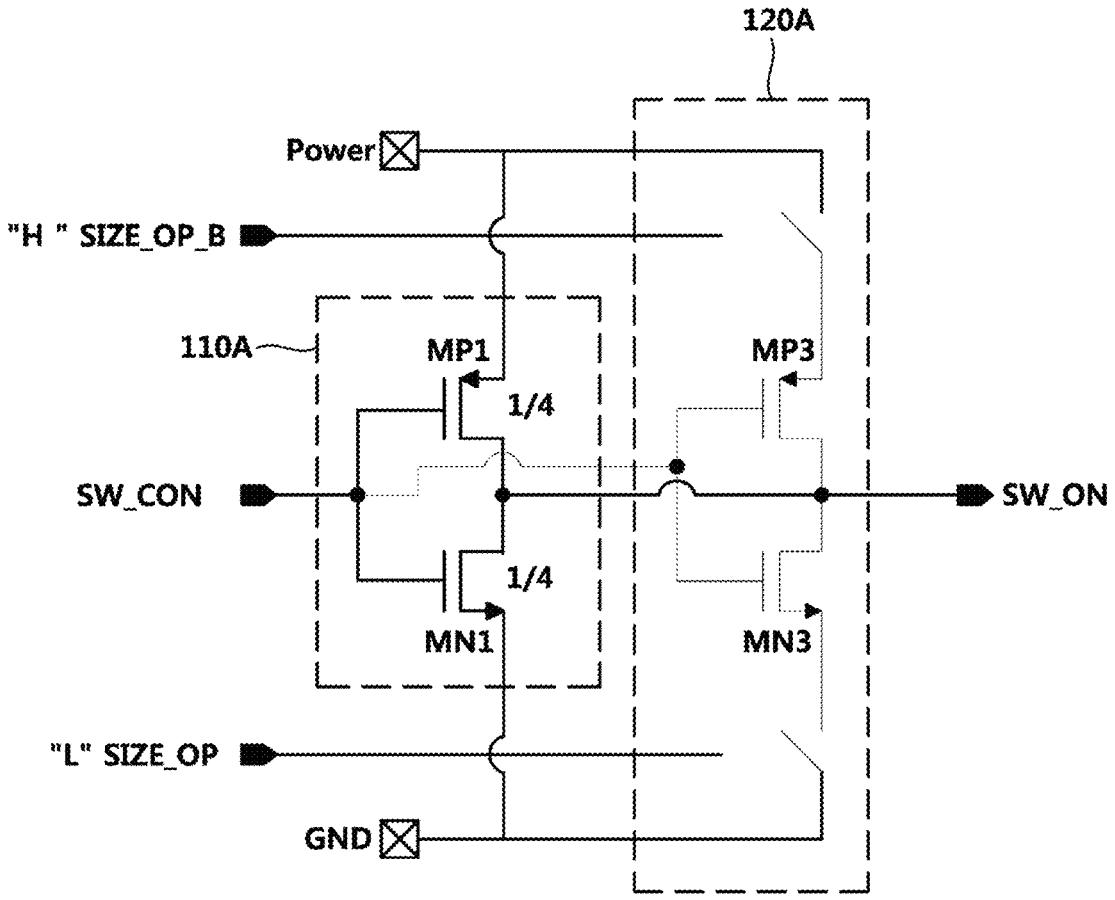
FIG. 5 is a circuit diagram for explaining examples of reduction in a control buffer according to the present examples.
Figure 6:
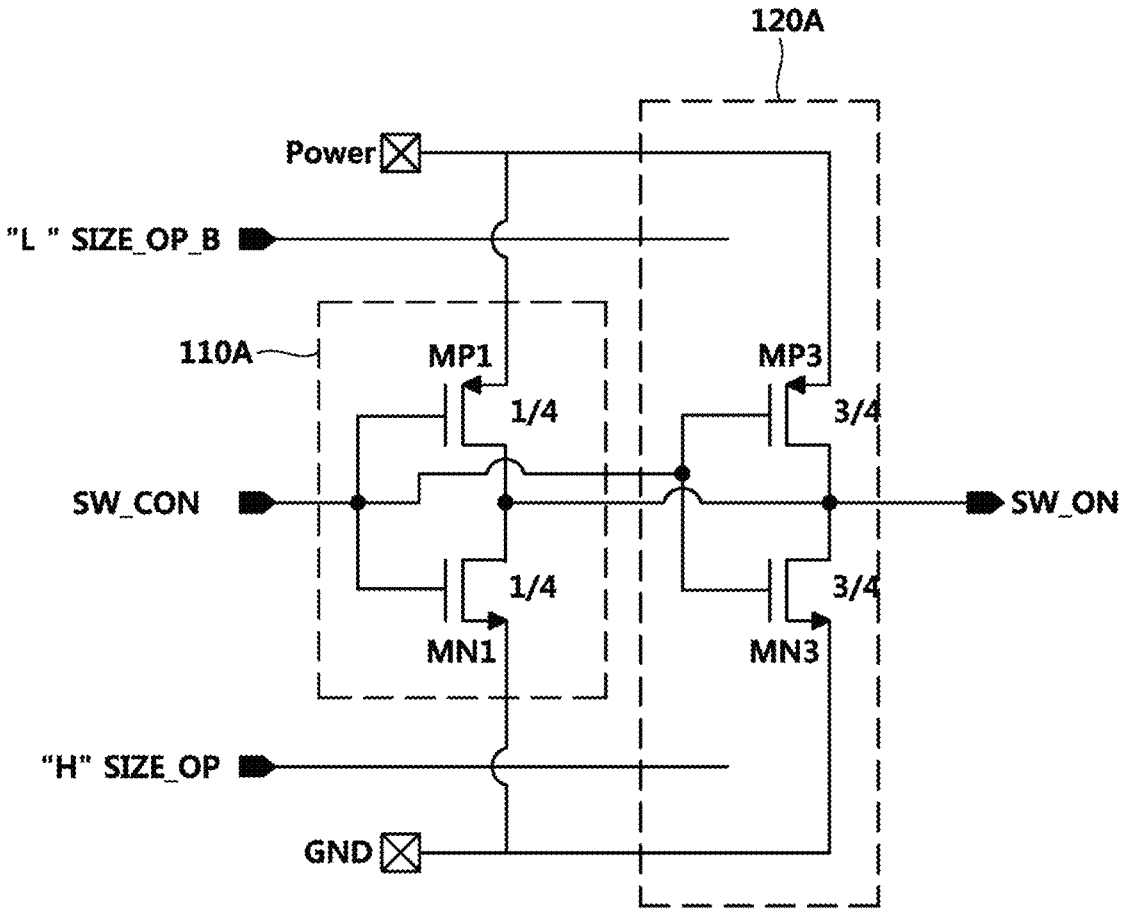
FIG. 6 is a circuit diagram for explaining examples of increase in a control buffer according to the present examples.

FIG. 5 is a circuit diagram for explaining an example in which the size of the control buffer is reduced according to the present examples, and FIG. 6 is a circuit diagram for explaining an example in which the size of the control buffer is increased according to the present examples.

Because the structure and operation of each of the second CMOS inverter 130 and the second tri-state inverter 140 are substantially the same as or similar to the structure and operation of each of the first CMOS inverter 110A and the first tri-state inverter 120A, as discussed above, only a method of operating the first CMOS inverter 110A and the first tri-state inverter 120A is representatively illustrated and described, for brevity.

Referring to the example of FIG. 5, when the control signal SIZE_OP is in a low state L, the second NMOS transistor MN2 is turned off. Additionally, at the same time, the complementary signal SIZE_OP_B of the second control signal is in a high state H, the second PMOS transistor MP2 is also turned off. At that point, a voltage applied to the source of the third PMOS transistor MP3 and the source of the third NMOS transistor MN3 is zero. Thus, the first tri-state inverter 120A is placed in a high impedance state.

At this time, a first NMOS transistor MN1 operates when the first control signal SW_CON is a high state H. Thus, the size of a control buffer 100A becomes ¼, which is also the size of the first NMOS transistor MN1.

On the contrary, when the first control signal SW_CON is in a low state L, the first PMOS transistor MP1 is driven. Thus, the size of the control buffer 100A becomes ¼ which is the size of the first PMOS transistor MP1.

Briefly, when the second control signal SIZE_OP is in the low state L, the peak current of the switch signal SW_ON decreases because the size of the control buffer 100A is reduced to ¼ of the size it would otherwise be, in an alternative technology.

Referring to the example of FIG. 6, when the second control signal SIZE_OP is in a high state H, the second NMOS transistor MN2 is turned on, and the complementary signal SIZE_OP_B of the second control signal is in a low state L. Therefore, the second PMOS transistor MP2 is also turned on. Then, the third PMOS transistor MP3 and the third NMOS transistor are in a state in which they can conduct at any time. Therefore, here, the control buffer 100A is placed in a standby state.

At this time, when the first control signal SW_CON is in a high state H, the first NMOS transistor MN1 and the third NMOS transistor MN3 are driven accordingly. Therefore, the size of the control buffer 100A is 1, which is the sum of ¼, which is the size of the first NMOS transistor MN1, and ¾, which is the size of the third NMOS transistor MN3.

By contrast, when the first control signal SW_CON is in a low state L, the first PMOS transistor MP1 and the third PMOS transistor MP3 are driven accordingly. Therefore, the size of the control buffer 100A is 1, which is the sum of ¼, which is the size of the first PMOS transistor MP1, and ¾, which is the size of the third PMOS transistor MP3.

Briefly, when the second control signal SIZE_OP is in a high state H, the size of the control buffer 100A increases to 1, and thus, the slew rate of the switch signal SW_ON increases as well.

The above discussion is summarized in Table 1 below.

TABLE 1

| SIZE_OP | SW_CON | MP2 | MN2 | MP3 | MN3 | drive TR | Effect |
|---|---|---|---|---|---|---|---|
| L | H | OFF | OFF | OFF | OFF | MN1 | Peak Current |
| | L | OFF | OFF | OFF | OFF | MP1 | Decreased |
| H | H | ON | ON | OFF | ON | MN1, MN3 | Slew Rate Increased |
| | L | ON | ON | ON | OFF | MP1, MP3 | |

Figure 7:
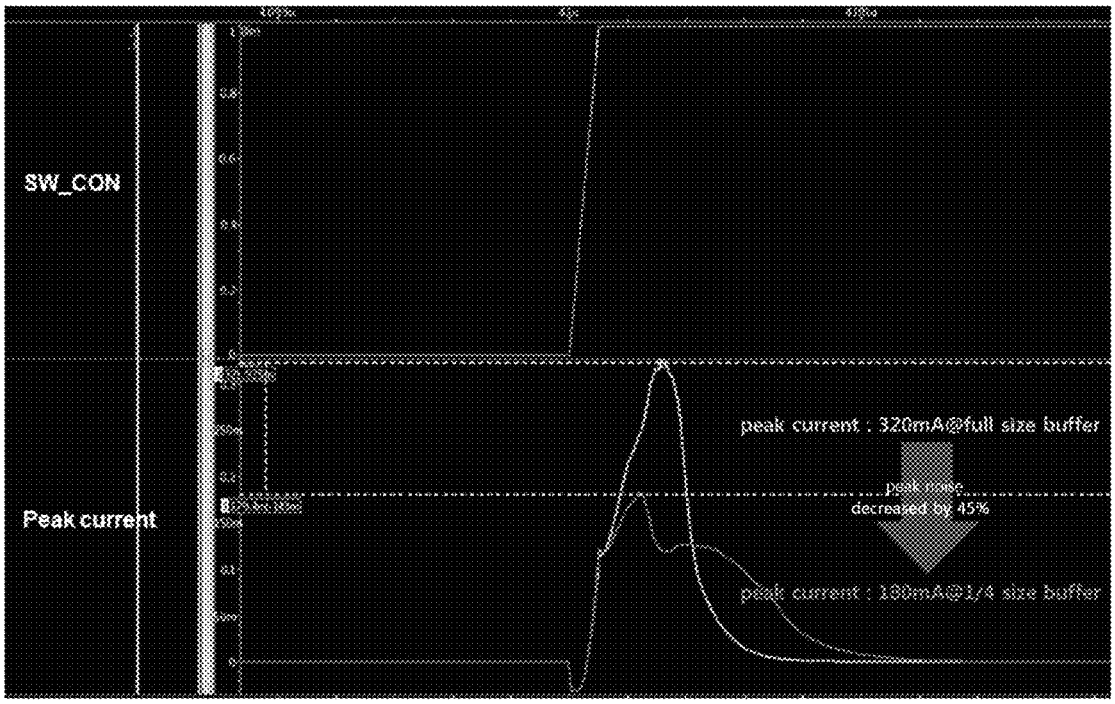
FIG. 7 shows a simulation result of peak current according to a switch control signal.

FIG. 7 is a simulation result showing a peak current according to a switch control signal. When the first control signal SW_CON is in a high state H and the second control signal SIZE_OP for controlling the size of the control buffer is in a high state H, the peak current is about 320 mA high. However, when the second control signal SIZE_OP is in a low state L, the peak current is reduced by 45% to about 180 mA.

Figure 8:
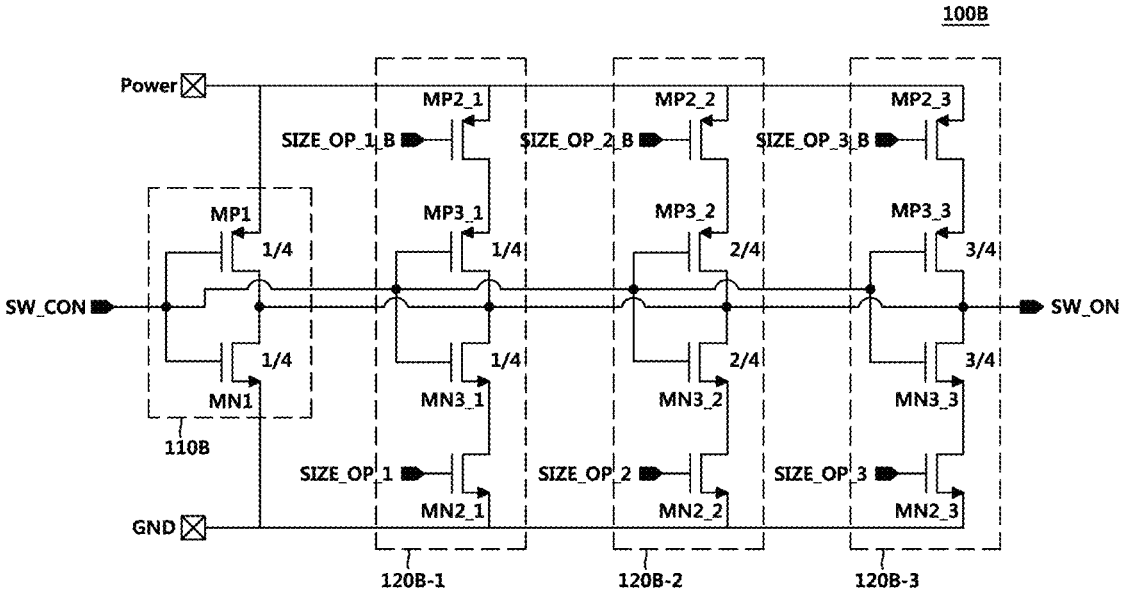
FIG. 8 illustrates an extended example of a control buffer.

FIG. 8 shows an extended example of the control buffer. Referring to the example of FIG. 8, a plurality of first tri-state inverters 120B-1, 120B-2, 120B-3 are connected to an output terminal of a first CMOS inverter 110B to output the switch signal SW_ON. In addition, in such an example, a plurality of second tri-state inverters are connected to an output terminal of a second CMOS inverter to output a complementary signal SW_ON_B of a switch signal.

Because the structure and operation of each of the second CMOS inverter and the plurality of second tri-state inverters are substantially the same as or similar to the structure and operation of each of the first CMOS inverter 110B and the plurality of first tri-state inverters 120B-1, 120B-2, 120B-3, only a method of operating the first CMOS inverter 110B and the plurality of first tri-state inverters 120B-1, 120B-2, and 120B-3 is representatively illustrated and described for brevity.

FIG. 9 illustrates an operational principle of the control buffer of the example of FIG. 8. Referring to the examples of FIGS. 8 and 9, when three tri-state inverters 120B-1, 120B-2, 120B-3 are connected to the output terminal of the inverter 110B, the second control signal for controlling the size of the control buffer may include three control signals. For example, let the three control signals be a first size control signal SIZE_OP_1, a second size control signal SIZE_OP_2, and a third size control signal SIZE_OP_3.

First, when the first size control signal SIZE_OP_1, the second size control signal SIZE_OP_2, and the third size control signal SIZE_OP_3 are all in a low state L, the first PMOS transistor MP1 or the first NMOS transistor MN1 is driven according to a switch control signal SW_CON. Therefore, the size of the control buffer 100A is ¼.

Second, when the first size control signal SIZE_OP_1 is in a high state H and the second size control signal SIZE_OP_2 and the third size control signal SIZE_OP_3 are in a low state L, the first PMOS transistor MP1 and a third PMOS transistor MP3_1 or the first NMOS transistor MN1 and a third NMOS transistor MN3_1 are driven according to the switch control signal SW_CON. Therefore, in this scenario, the size of the control buffer 100A is ⅔.

Third, when the second size control signal SIZE_OP_2 is in a high state H and the first size control signal SIZE_OP_1 and the third size control signal SIZE_OP_3 are each in a low state L, the first PMOS transistor MP1 and a third PMOS transistor MP3_2 or the first NMOS transistor MN1 and a third NMOS transistor MN3_2 are driven according to the switch control signal SW_CON. Therefore, in this scenario, the size of the control buffer 100A is ¾.

Fourth, when the third size control signal SIZE_OP_3 is in a high state H and the first size control signal SIZE_OP_1 and the second size control signal SIZE_OP_2 are each in a low state L, the first PMOS transistor MP1 and a third PMOS transistor MP3_3 or the first NMOS transistor MN1 and a third NMOS transistor MN3_3 are driven according to the switch control signal SW_CON. Therefore, in this scenario, the size of the control buffer 100A is 4/4.

Fifth, when the first size control signal SIZE_OP_1 and the second size control signal SIZE_OP_2 are each in a high state H and the third size control signal SIZE_OP_3 is in a low state L, the first PMOS transistor MP1 and the third PMOS transistor MP3_1, MP3_2 or the first NMOS transistor MN1 and the third NMOS transistor MN3_1, MN3_2 are driven according to the switch control signal SW_CON. Therefore, in this scenario, the size of the control buffer 100A is 4/4.

Sixth, when the first size control signal SIZE_OP_1 and the third size control signal SIZE_OP_3 are each in a high state H and the second size control signal SIZE_OP_2 is in a low state L, the first PMOS transistor MP1 and the third PMOS transistor MP3_1, MP3_3 or the first NMOS transistor MN1 and the third NMOS transistor MN3_1, MN3_3 are driven according to the switch control signal SW_CON. Therefore, in this scenario, the size of the control buffer 100A is 5/4.

Seventh, when the second size control signal SIZE_OP_2 and the third size control signal SIZE_OP_3 are in high state H and the first size control signal SIZE_OP_1 is in a low state L, the first PMOS transistor MP1 and the third PMOS transistor MP3_2, MP3_3 or the first NMOS transistor MN1 and the third NMOS transistor MN3_2, MN3_3 are driven according to the switch control signal SW_CON. Therefore, in this scenario, the size of the control buffer 100A is 6/4.

Eighth, when the first size control signal SIZE_OP_1, the second size control signal SIZE_OP_2, and the third size control signal SIZE_OP_3 are all in a high state H, the first PMOS transistor MP1 and the third PMOS transistor MP3_1, MP3_2, MP3_3 or the first NMOS transistor MN1 and the third NMOS transistor MN3_1, MN3_2, MN3_3 are driven according to the switch control signal SW_CON. Therefore, in this scenario, the size of the control buffer 100A is 7/4.

In summary, the size of the control buffer 100B increases in response to an increase in a number of tri-state inverters operating as inverters. Also, when the sizes of the transistors of each tri-state inverter are different, the size of the control buffer 100B increases as the size of the transistor operating as the inverter increases.

Accordingly, the control buffer according to the above examples adjusts a slew rate of a switch signal that controls respective output switches of a source driver depending on the control buffer.

In addition, a source driver including the control buffer according to the above examples selectively adjusts a size of the control buffer depending on a load of the display panel, thereby reducing EMI phenomena associated with the switch signal.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A control buffer in a source driver, the control buffer comprising:

a first CMOS inverter connected to a first tri-state inverter, wherein an output of the first tri-state inverter is supplied to an input of a second CMOS inverter , wherein an output of the second CMOS inverter is supplied to an output of a second tri- state inverter, wherein a switch signal is output from the output of the first tri-state inverter, and wherein a complementary signal of the switch signal is output from the output of the second tri-state inverter.

2. The control buffer of claim 1, wherein the first CMOS inverter comprises:

an input line configured to receive a first control signal;

an output line configured to output the switch signal; and each of a first PMOS transistor and a first NMOS transistor comprising a gate commonly connected to the input line and a drain commonly connected to the output line, wherein the first CMOS inverter is configured to invert the first control signal received from the input line and configured to output the inverted first control signal to the output line as the switch signal.

3. The control buffer of claim 2, wherein the first PMOS transistor and the first NMOS transistor are each a ¼ size transistor.

4. The control buffer of claim 3, wherein the first tri-state inverter, depending on a state of a second control signal, is configured to operate as an inverter that inverts the first control signal received from the input line and outputs the inverted first control signal to the output line of the first CMOS inverter, or is placed in a high impedance state and is configured not to output a signal to the output line, regardless of the first control signal.

5. The control buffer of claim 4, wherein a size of the control buffer increases in response to the first tri-state inverter operating as the inverter.

6. The control buffer of claim 4, wherein the first tri-state inverter comprises:

a second NMOS transistor that comprises a gate configured to receive the second control signal;

a second PMOS transistor that comprises a gate configured to receive a complementary signal of the second control signal; and each of a third PMOS transistor and a third NMOS transistor comprising a gate commonly connected to the input line and a drain commonly connected to the output line, wherein a drain of the second PMOS transistor is connected to a source of the third PMOS transistor, and a drain of the second NMOS transistor is connected to a source of the third NMOS transistor.

7. The control buffer of claim 6, wherein the third PMOS transistor and the third NMOS transistor are each a ¾ size transistor.

8. The control buffer of claim 1, :

wherein a slew rate of the complementary signal of the switch signal is adjusted depending on the size of the control buffer.

9. The control buffer of claim 8, wherein a switch comprises a PMOS transistor and an NMOS transistor connected in parallel, a gate of the PMOS transistor is configured to receive the complementary signal of the switch signal, and a gate of the NMOS transistor is configured to receive the switch signal.

10. A control buffer in a source driver, the control buffer comprising:

a CMOS inverter configured to output a switch signal to control turning on and off of a switch controlled by the control buffer; and tri-state inverters that are each connected to the CMOS inverter, and depending on a state of each of which a size of the control buffer is selectively adjusted, wherein each tri-state inverter, depending on a state of a size control signal inputted therein, is configured to operate as an inverter that inverts a switch control signal received from an input line and configured to output the inverted switch control signal into an output line of the CMOS inverter, or is placed in a high impedance state and is configured not to output a signal into the output line, regardless of the switch control signal, wherein a slew rate of the switch signal is adjusted depending on the size of the control buffer.

11. The control buffer of claim 10, wherein, as the size of the control buffer decreases, electromagnetic interference (EMI) of the switch signal is reduced.

12. The control buffer of claim 10, wherein the CMOS inverter comprises:

the input line configured to receive athe switch control signal; and the output line configured to output the switch signal, wherein the CMOS inverter is configured to invert the switch control signal received from the input line and configured to output the inverted switch control signal into the output line as the switch signal.

13. The control buffer of claim 10, wherein the size control signal comprises a first size control signal, a second size control signal, and a third size control signal, the tri-state inverters comprise a first tri-state inverter configured to operate based on the first size control signal, a second tri-state inverter configured to operate based on the second size control signal, and a third tri-state inverter configured to operate based on the third size control signal, and each of the tri-state inverters comprises a corresponding second NMOS transistor comprising a gate configured to receive a corresponding size control signal, a corresponding second PMOS transistor comprising a gate configured to receive a corresponding complementary signal of the corresponding size control signal, and a corresponding third PMOS transistor and a corresponding third NMOS transistor comprising a gate commonly connected to the input line and a drain commonly connected to the output line, wherein a drain of each corresponding second PMOS transistor is connected to a source of each corresponding third PMOS transistor, and a drain of each corresponding second NMOS transistor is connected to a source of each corresponding third NMOS transistor.

14. The control buffer of claim 13, wherein each of the tri-state inverters is characterized such that, depending on a state of each of the size control signals, the corresponding third PMOS transistor or the corresponding third NMOS transistor is configured to operate as an inverter, or the corresponding third PMOS transistor and the corresponding third NMOS transistor are turned off, and as a size of the corresponding third PMOS transistor or the corresponding third NMOS transistor increases, a size of a control buffer increases.

15. The control buffer of claim 13, wherein, in response to the switch control signal being in a high state, the size of the control buffer is adjusted by a combination of the third NMOS transistor of the first tri-state inverter, the third NMOS transistor of the second tri-state inverter, and the third NMOS transistor of the third tri-state inverter, depending on a state of each of the size control signals.

16. The control buffer of claim 13, wherein, in response to the switch control signal being in a low state, the size of the control buffer is adjusted by a combination of the third PMOS transistor of the first tri-state inverter, the third PMOS transistor of the second tri-state inverter, and the third PMOS transistor of the third tri-state inverter, depending on a state of each of the size control signals.

17. The control buffer of claim 16, wherein, in response to the first size control signal, the second size control signal, and the third size control signal all being in a low state, the control buffer has a smallest size; and in response to the first size control signal, the second size control signal, and the third size control signal all being in a high state, the control buffer has a largest size.

18. A source driver of a display panel, the source driver comprising:

a channel amplifier configured to receive a driving voltage to be output into a source line of the display panel for amplification;

a switch that connects an output terminal of the channel amplifier to the source line; and a control buffer configured to supply a switch signal to the switch to control of turning on and off of the switch;

a logic configured to generate a switch control signal and a size control signal; and a level shifter configured to receive and shift the level of each of the switch control signal and the size control signal in order to provide it to the control buffer.

19. The source driver of claim 18, wherein, as a load of the display panel increases, a size of the control buffer increases, and as the load of the display panel decreases, the size of the control buffer decreases.

20. The source driver of claim 18, wherein the control buffer comprises:

a CMOS inverter configured to output the switch signal based on a switch control signal; and a tri-state inverter, connected to the CMOS inverter, configured to selectively adjust a size of the control buffer based on a size control signal, wherein operation of the tri-state inverter is controlled depending on a load of the display panel.

21. The source driver of claim 20, wherein the tri-state inverter, depending on a state of the size control signal, is configured to operate as an inverter that inverts the switch control signal and configured to output the inverted switch control signal as the switch signal, or is placed in a high impedance state and is configured not to output a signal, regardless of the switch control signal.

* * * * *